US006035456A

United States Patent [19]

Taylor

[11] Patent Number: 6,035,456

[45] Date of Patent: Mar. 14, 2000

[54] SPLASH GUARD AND STORAGE APPARATUS FOR PLUNGERS

[76] Inventor: John E. Taylor, 867 Oliver Rd., Clarksville, Tenn. 37042

[21] Appl. No.: 09/138,963

[22] Filed: Aug. 24, 1998

[51] Int. Cl.[7] ..... E03D 11/00

[52] U.S. Cl. ..... 4/255.11; 206/349

[58] Field of Search ..... 4/255.01, 255.11; 206/349

[56] References Cited

U.S. PATENT DOCUMENTS

| | | | |
|---|---|---|---|
| D. 238,917 | 2/1976 | Vrignaud | D6/551 X |
| D. 290,798 | 7/1987 | Zuliani | D6/551 |
| D. 315,989 | 4/1991 | Levien | D4/137 |
| D. 368,820 | 4/1996 | Sander | D6/551 |
| 4,458,368 | 7/1984 | Webb | 4/255.11 |
| 5,099,527 | 3/1992 | Roose | 4/255.11 |
| 5,114,006 | 5/1992 | Wilk | 206/349 |
| 5,305,882 | 4/1994 | Kaplan | 206/349 |
| 5,456,356 | 10/1995 | Kurzawa | 206/349 |

*Primary Examiner*—Robert M. Fetsuga
*Attorney, Agent, or Firm*—Waddey & Patterson, P.C.; Emily A. Shouse

[57] ABSTRACT

A splash guard and storage apparatus for use with plungers is disclosed. The apparatus includes a shield, a handle, grip, and basin. The plunger rod may be inserted through the shield, handle, and grip. The shield may be positioned along the length of the handle with the grip to block debris that might be expelled during the use of a standard plunger to unclog an apparatus such as a sink or toilet. Additionally, the shield is designed to be attached to the basin, and the apparatus further includes several locking embodiments to keep the shield attached to the basin. The basin further includes several embodiments of the base, such as the addition of dimples or ribs, to allow fresh air to circulate around the suction cup of the plunger. Additionally, a mesh weave may be inserted into the basin to allow for retention of anti-bacterial chemicals, which contact the plunger during storage.

32 Claims, 5 Drawing Sheets

SPLASH GUARD AND STORAGE APPARATUS FOR PLUNGERS

BACKGROUND OF THE INVENTION

The present invention relates generally to a bathroom accessory for use with a plunger and more particularly to an apparatus for blocking the expulsion of debris during the use of a plunger to unstop a clogged apparatus, and a storage means to keep the plunger securely contained when not in use.

There have been other designs that have attempted to solve the problem of germs associated with debris propelled through the use of a plunger and the germs connected to a plunger after use. Such a design is described by Kaplan in U.S. Pat. No. 5,305,882. Kaplan describes a self-storing collapsible apparatus in which the collapsible plunger rod is attached to a cover so that when the rod is collapsed, the cover will extend down and cover the suctioning cup of the plunger. The cover is permanently attached to the top of the rod, and serves to conceal the plunger when the plunger is not being used and to protect the plunger user's hands from debris when the plunger is being used. Although Kaplan's design blocks expelled debris from coming into contact with the user's hands, it fails to protect the rest of the user's body since the shield must remain in the same position at the top of the plunger rod.

Another design is described by Wilk in U.S. Pat. No. 5,114,006. Wilk describes a plunger connected to a containment system for housing the plunger rod and the suction cup. The housing further serves as a handle in using the plunger. However, Wilk's design does nothing to block the debris that is expelled during the use of the plunger to prevent the debris from coming into contact with the plunger user.

Additionally, Design Patent No. 368,820 describes a contraption for containing a plunger using a bucket having a non-flat base surface and a lid that extends over the rod of the plunger. This invention does not serve as a shield for the user in that the lid has no means of staying positioned on the plunger handle at any particular time during the use of the plunger. Furthermore, the lid has no means for locking itself to the containment basin and therefore allows easy removal of the lid to the basin, which would allow germs to be expelled into the air whenever the apparatus is toppled.

Consequently, none of the patents described above provide a shield to protect more than a person's hands during the use of a plunger. Furthermore none of the designs described above provide for a method for locking a contained plunger when the plunger is not in use so that germs will not be expelled through the toppling of the basin during storage.

SUMMARY OF THE INVENTION

The present invention is a splash guard apparatus for use with a conventional plunger having a plunger rod and a suction cup. The splash guard apparatus includes a shield and handle that have a hole designed so that the plunger rod can be inserted in the hole. When the plunger rod is inserted into the shield, a plunger user is protected from coming into contact with debris that is expelled when the plunger is being used to unclog a clogged apparatus such as a toilet bowl or a sink. A grip is attached to the inside surface of the handle to position the shield along the length of the plunger rod. The splash guard apparatus further includes a containment basin that provides a storage means for the plunger.

The grip is made of a flexible material and is designed to contact the plunger rod when the plunger rod is inserted into the hole of the handle and shield. The grip has at least one projection or arm that can be bent when in contact with the plunger rod so that the handle and shield can be slid to various points along the length of the plunger rod. Once the position has been attained, the grip continues to maintain contact with the plunger rod to secure the shield to the plunger rod.

One embodiment of the design further provides a collar attached to the edge of the shield. The collar is able to secure the shield to the basin when the plunger is inserted into the basin for storage purposes.

Another embodiment of the design provides a shoulder that is attached to the inside surface of the containment basin. The shoulder thereby supports the shield when the plunger is inserted into the basin for storage.

In a further embodiment, the splash guard apparatus has at least one locking tab attached to the shield, and the basin has a receiving groove either in the basin itself or in the collar of the basin. The locking tab thereby engages the receiving groove to lock the shield to the basin. The locking tab will either extend outward from the shield when it is to be received by the receiving groove in the basin, or the locking tab will extend downward from the shield when the locking tab is to be received by the receiving groove in the collar. By using the locking tabs, the shield is secured to the basin when the plunger is inserted into the basin.

Another embodiment of the design further includes a latch that is attached to the top of the shield. The wall of the basin has a latching hole, and the latch engages the latching hole when the user aligns the latch and the latching hole together and the plunger is inserted into the basin. This again locks the basin with the shield to prevent any germs from escaping from around the plunger suction cup. A detent may also be provided on the inside surface of the basin wall opposite the latching hole, which would provide a fulcrum point for inserting the shield into the basin and latching the basin with the shield.

Additionally, the splash guard apparatus may include further embodiments for the basin. For example, a mesh weave may be fitted into the base of the basin thereby allowing an anti-bacterial mixture to be applied to the mesh weave for the purpose of killing any germs that may surround the suction cup of the plunger. Also, the base of the basin may comprise at least one rib or a set of dimples that rise up from the base. The ribs and dimples serve to provide a pocket of air below the cup of the plunger, whereby the plunger would not stick to the bottom of the basin.

Furthermore, the basin may be shaped such that the circular opening of the basin has a greater diameter of the base of the basin. This would allow for a larger shield to be implemented in this design to provide a greater protection area from the user from expelled debris during the use of this plunger.

A method for blocking the scattering of water and debris during the use of a plunger to remove debris from a clogged apparatus, the plunger having a rod and a suction cup, the method comprising extending a shield and a handle having a central hole over the plunger rod, engaging the plunger rod with a grip attached to the inside surface of the handle, plunging the plunger into a body of water standing in the clogged apparatus and blocking the debris from coming contact with the plunger user with the shield. The method further comprising inserting the suction cup into a storage basin, sliding the shield and the handle along the plunger rod towards the suction cup and fastening the shield to the storage basin. The method further comprising during the sliding step, flexing the grip and thereby reducing a frictional engagement of the rod by the grip.

What is needed then, and is not found in the prior art, is an apparatus for protecting a plunger user for expelled debris during the use of the plunger to unclog an apparatus and to protect the plunger from human contact when the plunger is not being used.

DESCRIPTION OF THE PREFERRED EMBODIMENT

Figure 1:
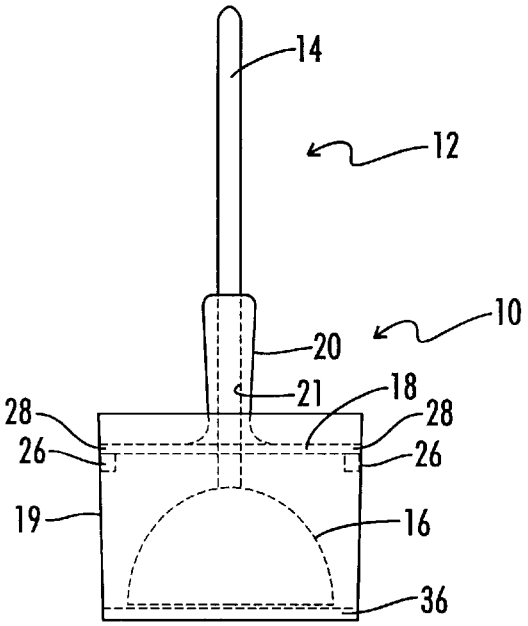
FIG. 1 is a side view of the splash guard apparatus, the plunger being in the stored position.
Figure 2:
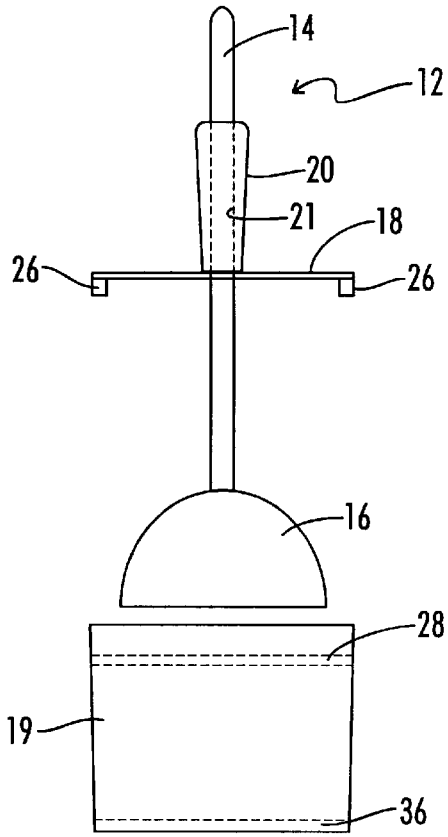
FIG. 2 is a side view of the splash guard apparatus, the plunger being in the unstored position with the shield and handle of the splash guard apparatus engaging the rod of the plunger.

Referring now to the drawings, FIGS. 1 and 2 are a side views of the splash guard apparatus 10 with a plunger 12 being stored in FIG. 1 and not stored in FIG. 2. The plunger 12 is a conventional plunger having a plunger rod 14 and a suction cup 16. The splash guard apparatus 10 includes a shield 18 that is used to protect the plunger user (not shown) from coming into contact with debris (not shown) expelled during the use of the plunger 12 with a clogged apparatus such as a toilet bowl or a sink (not shown). The splash guard apparatus 10 further includes a handle 20 that is attached to the shield 18. The handle 20 and the shield 18 both have a hole 21 extending through them to permit the plunger rod 14 to extend through the shield 18 and the handle 20. A grip 22 is further attached to the inside surface of the handle 20 to provide contact with the plunger rod 14 so as to position the shield 18 along the length of the plunger rod 14. The splash guard apparatus 10 additionally includes a containment basin 19 for storing the plunger 12 when the plunger 12 is not in use.

Figure 3:
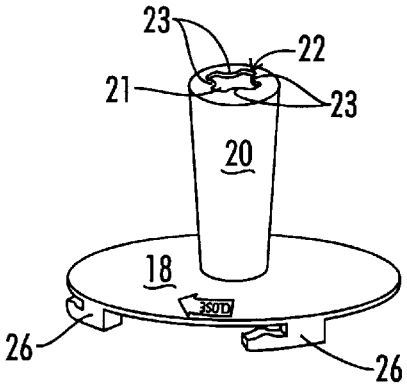
FIG. 3 is a perspective view of the shield, handle, and grip of the splash guard apparatus.
Figure 4:
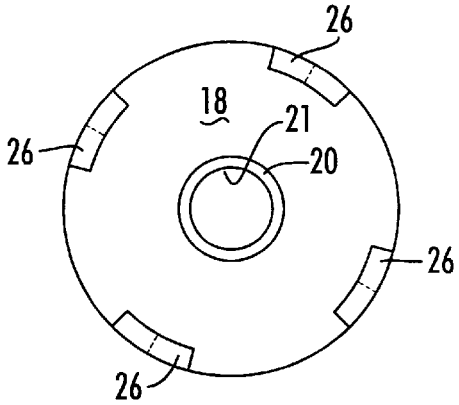
FIG. 4 is a top view of the shield and handle of the splash guard apparatus with the locking tabs shown in phantom.

The grip 22, examples of which are shown in FIGS. 6*a*–6*d*, is made of a flexible material and is designed to contact the plunger rod 14 when the plunger rod 14 is inserted into the hole. The grip 22 (as shown in FIG. 3) has at least one projection 23 that can be bent when in contact with the plunger rod 14 so that the handle 20 and shield 18 can be slid to various points along the length of the plunger rod 14. When the position has been attained, the grip 22 continues to maintain contact with the plunger rod 14 to secure the shield 18 to the plunger rod 14.

Figure 10:
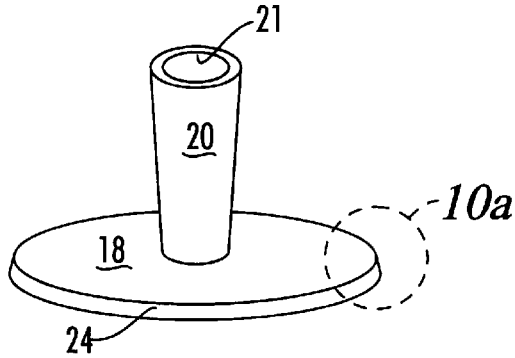
FIG. 10 is a perspective view of the handle and shield of the splash guard apparatus, with a collar attached to the shield.
Figure 10A:
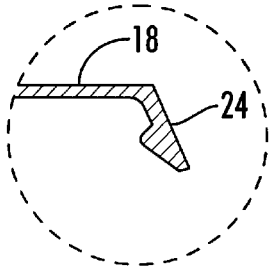
FIG. 10*a* is a detail view of the collar.

One embodiment of the splash guard apparatus 10 further includes a collar 24 that surrounds the edge of the shield 18 (shown in FIG. 10). The collar 24 is designed to engage the basin 19 and to secure the shield 18 of the splash guard apparatus 16 to the basin 19 when the plunger 12 is inserted into the basin 19. Such an embodiment allows the shield 18 to work with various preexisting basins 19 that have the same diameter as the shield 18.

Figure 5:
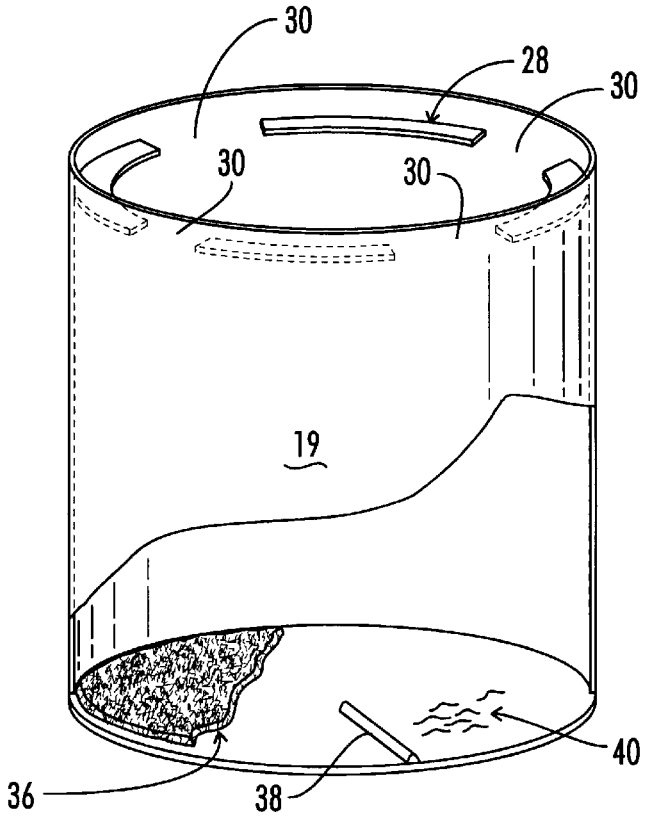
FIG. 5 is a perspective view of the basin of the splash guard apparatus, a shoulder being shown at the top of the basin. A portion of the side wall is cut-away to show interior features including a partial view of the sponge positioned in the base of the basin, and a typical rib and dimples.
Figure 6A:
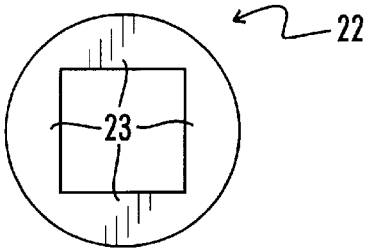
FIGS. 6*a*–6*d* are top views of the grip, each view showing a different embodiment for the projection of the grip used to engage the plunger rod.
Figure 6B:
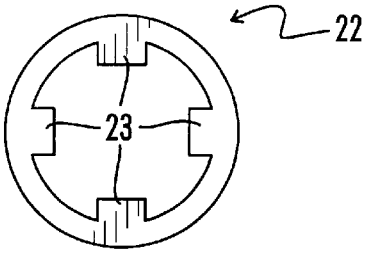
Figure 6C:
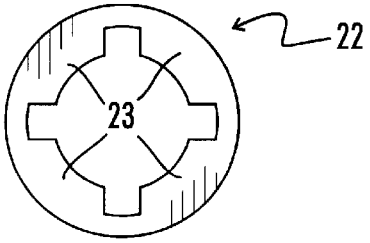
Figure 6D:
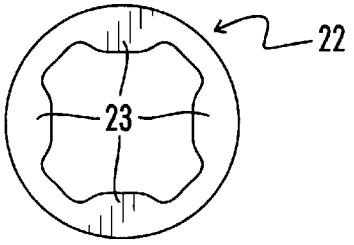

Another embodiment of the splash guard apparatus 10 includes a shoulder 28 that is attached to the inside surface of the basin 19 (shown in FIG. 5). The shoulder 28 is positioned on the wall of the basin 19 to support the shield 18 when the plunger 12 is inserted into the basin 19.

Figure 7:
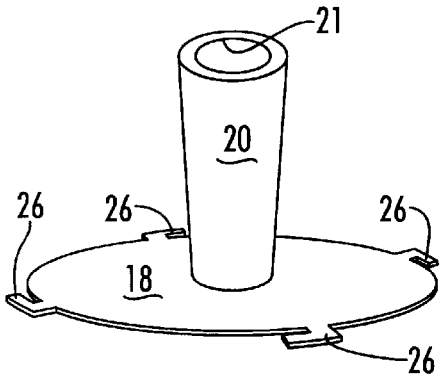
FIG. 7 is a perspective view of the handle and the shield of the splash guard apparatus with a series of locking tabs extending outward from the shield.
Figure 8:
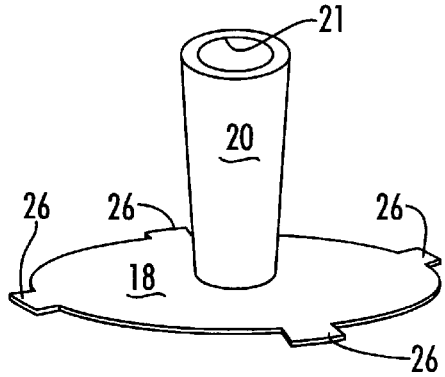
FIG. 8 is a perspective view of the handle and shield of the splash guard apparatus with a series of square locking tabs extending outward from the shield.
Figure 9:
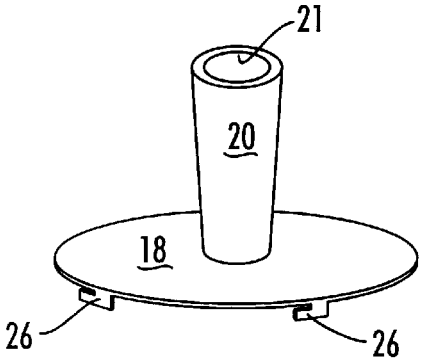
FIG. 9 is a perspective view of the handle and the shield of the splash guard apparatus with a series of locking tabs extending downward from the shield.
Figure 14:
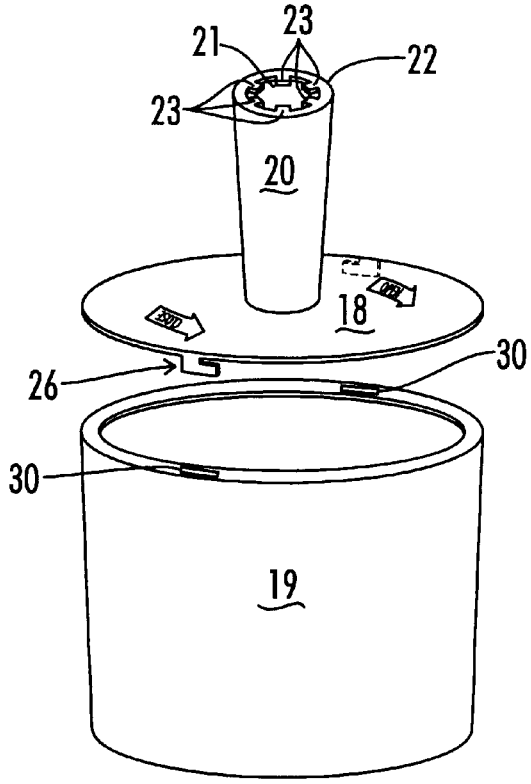
FIG. 14 is a perspective view of the splash guard apparatus with a series of locking tabs to be inserted into locking tab holes in a basin.

The splash guard apparatus 10 additionally includes several embodiments for locking the shield 18 to the basin 19. One of these embodiments includes the addition of at least one locking tab 26 attached to the shield 18. The locking tab 26 may extend outward from the shield 18 along the shield's edge, as shown in FIGS. 7 and 8, or the locking tab 26 may extend downward from the shield 18 as shown in FIGS. 3, 4, 9, 14, and 15. Additionally, there are receiving grooves 30 found in either the top edge of the wall of the basin 19 or in the shoulder 28 of the basin 19. When the locking tab 26 extends outward from the shield 18 (shown in FIGS. 7 and 8), it engages the receiving groove 30 in the wall of the basin 19, and thereby secures the shield 18 to the basin 19 when the plunger 12 is inserted into the basin 19. When the locking tab 26 extends downward from the shield 18 (shown in FIGS. 3, 4, 9, 14, and 15), the locking tab 26 engages the receiving groove 30 in the shoulder 28 to secure the shield 18 to the basin 19 when the plunger 12 is inserted into the basin 19. In both embodiments, the locking tab 26 engages the receiving groove 30 as the shield 18 is lowered and rotated as is shown in FIG. 14.

Figure 11:
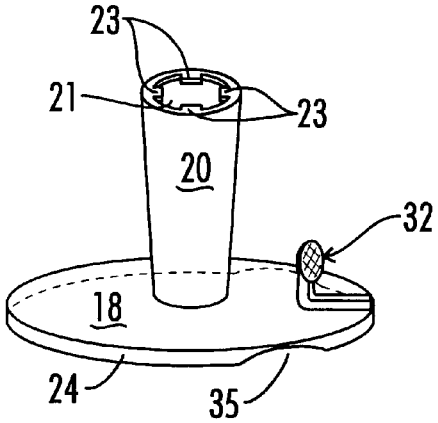
FIG. 11 is a perspective view of the handle, shield, grip, and locking tab of the splash guard apparatus with the shield further showing a series of arcs extending up on the collar whereby the shield is able to be removed from the basin.
Figure 12:
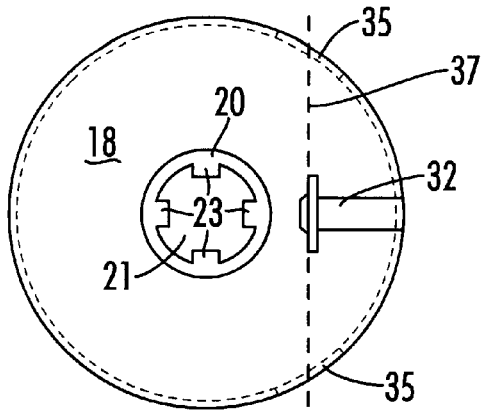
FIG. 12 is a top view of the splash guard apparatus shown in FIG. 11.
Figure 13:
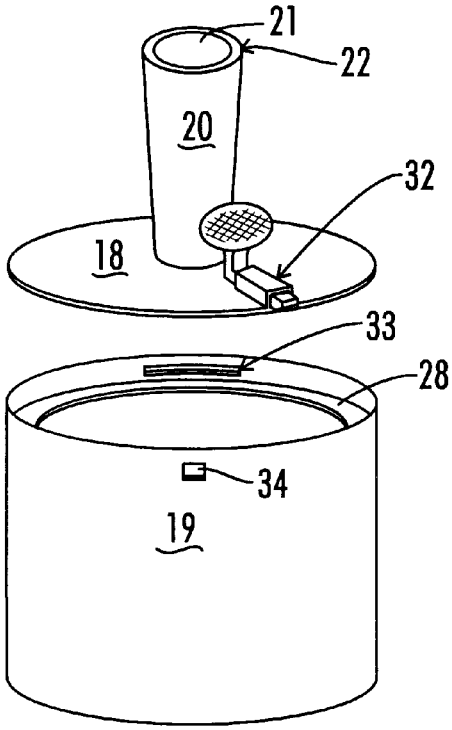
FIG. 13 is a perspective view of the splash guard apparatus with a latch attached to the shield to engage a latch hole in the basin when a plunger is inserted into the basin.

In another embodiment, a latch 32 can be attached to the shield 18, as shown in FIGS. 11–13, to lock the shield 18 to the basin 19. The wall of the basin 19 has a corresponding latching hole 34 (see FIG. 13) to receive the latch 32 when the latch 32 is aligned with a latching hole 34 and the plunger 12 is inserted into the basin 19. This embodiment may further include a detent 33 that is attached to the wall of the basin 19 opposite the latching hole 34. The detent 33 serves as a fulcrum when the shield 18 is being placed within the basin 19 and the latch 32 is engaging the latching hole 34. Furthermore, the shield 18 may be designed with a pair of arches 35 to allow easy removal of the shield 18 from the basin 19 (see FIGS. 11 and 12). The shield 18 is made of a material that allows the shield 18 to be bent along line 37 to permit a smooth disconnection with the basin 19. This embodiment is particularly useful when a latch 32 is attached to the shield 18 because the user may grip the latch 32 and the arch 35 with one hand to remove the shield 18.

The splash guard apparatus 10 is also designed to keep the germs away from the other users while the plunger 12 is in storage. The basin 19 is designed to allow a mesh fitting 36 to be inserted into the base of the basin 19, as shown in FIG. 5. A conventional anti-bacterial chemical solution can then be poured onto the mesh fitting 36 so that when the plunger 12 is in storage, any bacteria or other germs surrounding the plunger 12 will be eliminated.

Figure 15:
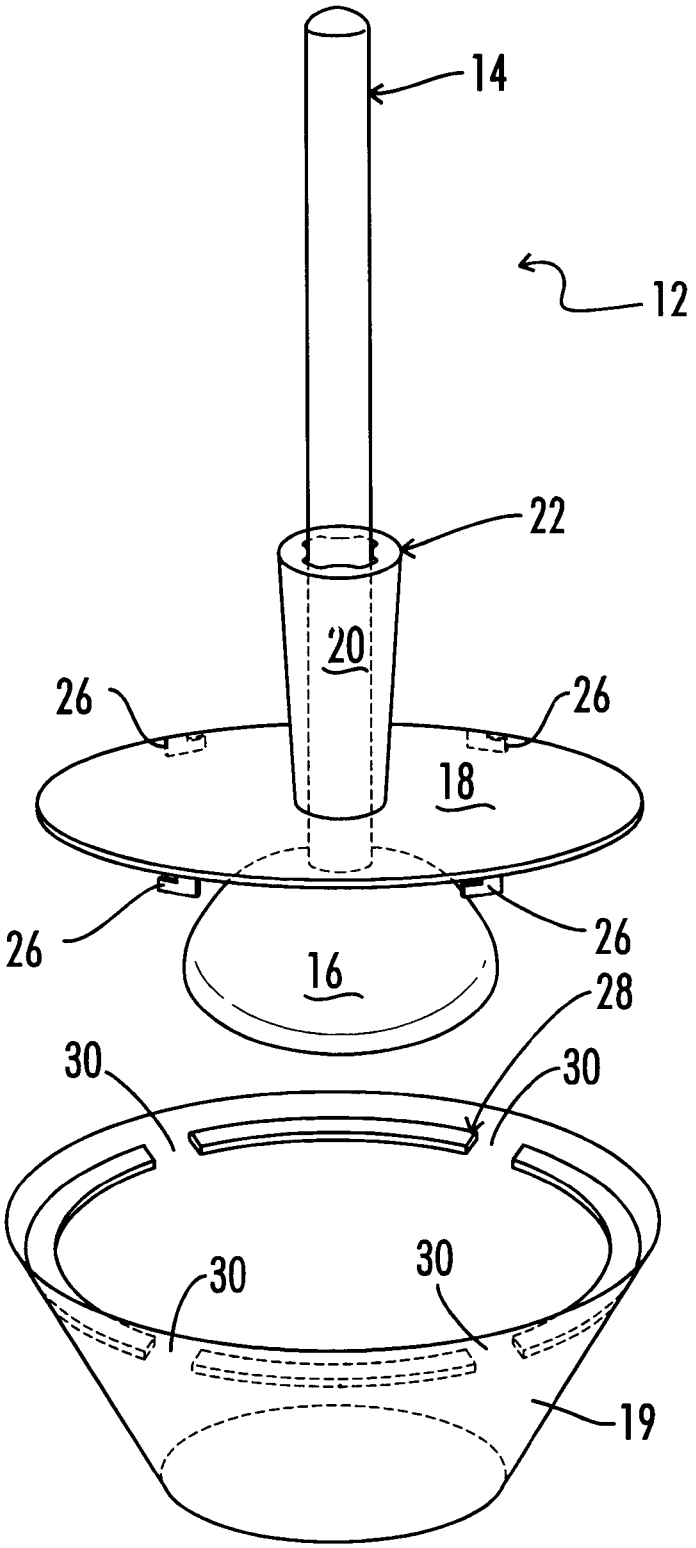
FIG. 15 is a perspective view of the splash guard apparatus having an extended shield and a basin having sloped walls.

The basin 19 can further be designed to accommodate a shield 18 having a diameter larger than the base of the basin 19, as shown in FIG. 15. This design allows the user to have a shield 18 with a diameter that provides greater protection from expelled debris.

The basin 19 and grip 22 are further designed so that circulating air can be distributed under the suction cup 16 and completely enfold the suction cup 16 when it is stored inside the basin 19. The grip 22 is designed so that there are gaps between the projections 23 so that air may travel through the grip 22, handle 20, and shield 18 into the basin 19. The base of the basin 19 is further designed to have an uneven bottom surface so that air might travel under the suction cup 16 that is stored in the basin 19. One such embodiment for providing an uneven surface is a series of ribs 38 that are arranged at the bottom of the basin 19, as shown in FIG. 5. Another embodiment also shown in FIG. 5 includes a series of dimples 40 that are arranged on the bottom of the basin 19. These embodiments therefore provide fresh air around the suction cup 16, which provides a quicker time for drying the suction cup 16 after use and further prevents the suction cup 16 from sticking to the base of the basin 19.

The above description and drawings are illustrative of the invention but should not be taken as limiting the scope thereof since the modifications of these teachings and other advantages will be apparent to those skilled in the art in view of the present disclosure.

Thus, although there have been described particular embodiments of the present invention of a new and useful splash guard apparatus for plungers, it is not intended that such references be construed as limitations upon the scope of this invention except as set forth in the following claims.

I claim:

1. A splash guard apparatus for protecting a plunger user from expelled water and debris associated with the use of a plunger having a rod and a suction cup, the splash guard apparatus comprising:

a shield for protecting the plunger user from contact with the debris expelled during the use of the plunger; and a handle attached to the shield, the handle having a length greater than its width;

the handle and the shield having a hole extending through the handle and the shield to permit the plunger rod to extend through the handle and the shield.

2. A splash guard apparatus for protecting a plunger user from expelled water and debris associated with the use of a plunger having a rod and a suction cup, the splash guard apparatus comprising:

a shield for protecting the plunger user from contact with the debris expelled during the use of the plunger;

a handle attached to the shield; and a grip attached to the handle;

the handle and the shield having a hole extending through the handle and the shield to permit the plunger rod to extend through the handle and the shield and the grip adapted to contact the plunger rod when the plunger rod is received through the hole.

3. The splash guard apparatus of claim 2, wherein the grip comprises at least one projection, the projection directed into the hole in the handle, the projection being made of a flexible material so that the projection may be bent to allow the handle and shield to move along the length of the rod and returned to the normal position to secure the shield to the plunger rod.

4. The splash guard apparatus of claim 1, further comprising a basin for containing the plunger, the basin having a base and a wall, the wall having a first and second edge, the first edge of the wall being attached to the base, the second edge of the wall defining an opening to allow the plunger to be placed in the basin, and the wall further having an inside and outside surface, the inside surface facing the base of the basin.

5. The splash guard apparatus of claim 4, wherein the shield is in the shape of a disc, the disc having a surrounding edge.

6. The splash guard apparatus of claim 5, further comprising a collar attached to the edge of the disc, the collar engaging the basin to secure the shield to the basin.

7. The splash guard apparatus of claim 4, further comprising:

at least one locking tab attached to the shield, the locking tab extending radially out from the shield;

wherein the basin has a receiving slot in the second edge of the basin wall to receive the locking tab, the locking tab engaging the receiving slot to secure the splash guard apparatus to the basin.

8. The apparatus of claim 4 further comprising a shoulder attached to the inside surface of the basin wall, the shoulder supporting the shield when the plunger is inserted into the basin.

9. The apparatus of claim 8 further comprising:

at least one locking tab attached to the shield, the locking tab extending down from the shield;

wherein the shoulder has a receiving hole to receive the locking tab, the locking tab engaging the receiving hole to secure the shield to the basin.

10. The apparatus of claim 4 further comprising a latch attached to the shield, and wherein the wall of the basin has a latching hole, the latch further engaging the latching hole when the plunger user aligns the latch and the latching hole.

11. The apparatus of claim 10 wherein the basin further comprises a detent on the inside surface of the basin wall opposite the latching hole, the detent serving to guide the shield when in contact with the basin.

12. The apparatus of claim 4 further comprising a mesh weave for absorbing fluids, the mesh weave fitting into the base of the basin.

13. The apparatus of claim 4 wherein the base and the opening of the basin are circular, the base having a smaller diameter than the opening.

14. The apparatus of claim 4 wherein the basin further comprises at least one rib rising from the base to provide a pocket of air below the suction cup of the plunger when the plunger is in the basin.

15. The apparatus of claim 4 wherein the basin further comprises a series of dimples rising from the base to provide a pocket of air below the cup of the plunger when the plunger is in the basin.

16. A splash guard and storage apparatus for protecting a plunger user from expelled water and debris, the apparatus comprising:

a plunger having a rod and a suction cup;

a shield having a surrounding shield edge; and a handle attached to the shield, the handle having a length greater than its width;

the handle and shield having a hole extending through the handle and the shield and the plunger rod being slidably received through the hole so that the position of the shield and handle is adjustable along a length of the plunger rod.

17. The apparatus of claim 16 further comprising a basin, the basin having a base and a wall, the wall having a first and second wall edge, the first wall edge attached to the base and the second wall edge defining an opening for receiving the suction cup, the wall further having an inside and outside surface, the inside surface facing the base of the basin.

18. The splash guard apparatus of claim 17, further comprising:

at least one locking tab attached to the shield, the locking tab extending radially out from the shield;

wherein the basin has a receiving cavity in the second edge of the basin wall to receive the locking tab, the locking tab engaging the receiving cavity to secure the splash guard apparatus to the basin.

19. The apparatus of claim 17 further comprising a ring attached to the inside surface of the basin, the ring supporting the shield when the plunger is inserted into the basin.

20. The apparatus of claim 19 further comprising:

at least one locking tab attached to the shield, the locking tab extending down from the shield; and wherein the ring has a receiving groove to receive the locking tab, the locking tab engaging the receiving groove to secure the shield to the basin.

21. The apparatus of claim 17 further comprising a collar surrounding the shield edge, the collar engaging the basin and securing the shield to the basin when the plunger is inserted into the basin.

22. The apparatus of claim 17 further comprising a latch attached to the shield, and wherein the wall of the basin has a latching hole, the latch further engaging the latching hole when the user aligns the latch and the latching hole.

23. The apparatus of claim 22 wherein the basin further comprises a detent on the inside surface of the basin wall opposite the latching hole, the detent serving to guide the shield when in contact with the basin.

24. The apparatus of claim 17 further comprising a mesh weave and an anti-bacterial solution penetrating through the mesh weave, the mesh weave fitting into the base of the basin to absorb contaminated fluids and disinfect the plunger.

25. The apparatus of claim 17 wherein the base and opening of the basin are circular, the base having a smaller diameter than the opening.

26. The apparatus of claim 17 wherein the basin further comprises at least one rib rising from the base, the rib serving to provide a pocket of air below the cup of the plunger when the plunger is in the basin.

27. The apparatus of claim 17 wherein the basin further comprises a series of dimples rising from the base, the dimples serving to provide a pocket of air below the cup of the plunger when the plunger is in the basin.

28. A splash guard and storage apparatus for protecting a plunger user from expelled water and debris, the apparatus comprising:

a plunger having a rod and a suction cup;

a shield having a surrounding shield edge;

a handle attached to the shield; and a grip attached to the handle, the grip making contact with the plunger rod to secure the handle and shield to the plunger rod;

the handle and shield having a hole extending through the handle and the shield and the plunger rod being slidably received through the hole so that the position of the shield and handle is adjustable along a length of the plunger rod.

29. The splash guard apparatus of claim 28, wherein the grip comprises at least one arm, each arm being made of a flexible material so that the arm may be bent to allow the shield to be moved along the length of the plunger rod and returned to the original position to secure the shield to the plunger rod.

30. A method for blocking the scattering of water and debris during the use of a plunger to remove debris from a clogged apparatus, the plunger having a rod and a suction cup, the method comprising:

extending a shield and a handle having a central hole over the plunger rod;

engaging the plunger rod with a grip attached to the inside surface of the handle so that the shield is at a distance from the suction cup to prevent contact with the clogged aparatus;

plunging the plunger into a body of water standing in the clogged apparatus; and blocking the debris from coming in contact with the plunger user with the shield.

31. A method for blocking the scattering of water and debris during the use of a plunger to remove debris from a clogged apparatus, the plunger having a rod and a suction cup, the method comprising:

extending a shield and a handle having a central hole over the plunger rod;

engaging the plunger rod with a grip attached to the inside surface of the handle;

plunging the plunger into a body of water standing in the clogged apparatus;

blocking the debris from coming contact with the plunger user with the shield;

inserting the suction cup into a storage basin;

sliding the shield and the handle along the plunger rod towards the suction cup; and fastening the shield to the storage basin.

32. The method of claim 31, further comprising:

during the sliding step, flexing the grip and thereby reducing a frictional engagement of the rod by the grip.

* * * * *